United States Patent [19]

Kock et al.

[11] Patent Number: 4,570,925

[45] Date of Patent: Feb. 18, 1986

[54] DEVICE FOR EXERCISING MUSCLES ASSOCIATED WITH ELBOW TENDONITIS, INCLUDING ALSO THE HAND AND WRIST

[75] Inventors: Ronald W. Kock, Cincinnati; Charles E. Schuster, Fairfield, both of Ohio

[73] Assignee: Bio Mechanisms, Inc., Fairfield, Ohio

[21] Appl. No.: 664,514

[22] Filed: Oct. 25, 1984

[51] Int. Cl.[4] ..... A63B 21/00

[52] U.S. Cl. ..... 272/67; 272/68; 272/131; 272/135

[58] Field of Search ..... 128/25 R, 26; 272/67, 272/68, 93, 118, 130, 131, 135, 136

[56] References Cited

U.S. PATENT DOCUMENTS

| | | | |
|---|---|---|---|
| 4,171,802 | 10/1979 | Stoecker | 272/67 |
| 4,192,500 | 3/1980 | Crow et al. | 272/68 |
| 4,258,913 | 3/1981 | Brentham | 272/67 |
| 4,373,717 | 2/1983 | Lambert, Jr. | 272/67 |
| 4,482,149 | 11/1984 | Weldon | 272/67 |

*Primary Examiner*—Richard J. Apley
*Assistant Examiner*—J. Welsh
*Attorney, Agent, or Firm*—Frost & Jacobs

[57] ABSTRACT

A device for handgripping or squeezing, forearm twisting, wrist casting, wrist rocking and a combination of some of these. A handle mechanism is rotatably mounted on a frame. This mechanism includes a fixed handle and a movable handle, movement of the last mentioned handle being resisted by a force which may be varied. One may grasp the two handles simultaneously and exert the fingers so as to move the movable handle towards the fixed handle in opposition to the applied force. Rotation of the handle mechanism is provided with torsional resistance which may be varied. One may grasp the fixed handle with the arm in alignment with the axis of the device and rotate the handle mechanism in either direction or one may grasp the fixed handle with the arm disposed at right angles to the position previously described and rotate the handle mechanism in either direction. A third handle may be provided which is disposed at right angles to the fixed handle, in alignment with the axis of the device and which may be grasped by the user so as again to rock the handle mechanism in either direction. Squeezing resistance may be effected through a cable attached to the movable handle and to an extension spring. Torsional resistance may be effected between a rotatable friction disk and a slidable, but not rotatable, friction disk which may be forced against the rotatable friction disk by a force which may be varied.

14 Claims, 5 Drawing Figures

DEVICE FOR EXERCISING MUSCLES ASSOCIATED WITH ELBOW TENDONITIS, INCLUDING ALSO THE HAND AND WRIST

TECHNICAL FIELD

This invention relates generally to exercising devices and specifically to a device for strengthening the muscles of the arm, wrist and hand. More specifically the invention provides a means for strengthening the muscle surrounding the elbow joint for either the left or right arm. It is designed to prevent 'tennis elbow" or tendonitis at the elbow joint or, in the event that one has already been afflicted with this problem, to aid in recovering from it.

"Tennis elbow" or tendonitis at the elbow joint is generally believed to be caused by the twisting motion and impact forces generated, for example, in the service of a tennis ball, a golf swing, or other repeated elbow stressing activities. The prevention of this injury is best achieved by strengthening the muscles surrounding the joint, such that shock is absorbed by the muscles rather than the elbow tendons and sufficient muscle strength is available to overcome the stresses placed on the joint.

BACKGROUND ART

Exercising devices of various kinds have been developed through the years. Many kinds of "fitness programs" have been developed and in recent years these have become quite popular. The programs and associated apparatuses are intended to strengthen various parts of the body. None, however, seems to provide the plurality of exercising movements achieved by the instant invention as will be brought out below.

A search of the U.S. prior patent art was conducted in an effort to locate those devices most pertinent to the invention at hand. That search developed the following patents of interest noting, however, that although the search was intended to develop the most pertinent prior art, no assertion is made that these patents do in fact represent the closest art. The patents developed are:

U.S. Pat. No. 2,819,081—Touraine;
U.S. Pat. No. 4,093,214—Coker et al;
U.S. Pat. No. 4,239,210—Lambert, Jr.;
U.S. Pat. No. 4,258,913—Brentham;
U.S. Pat. No. 4,343,465—Allen;
U.S. Pat. No. 4,373,717—Lambert, Jr.

Touraine discloses an arrangement which appears primarily directed to offering resistance to wrist rotation. An inner ring 10 is located within an outer ring 7 and frictional resistance to rotation of the ring 10 within the ring 7 is offered by adjustable set screws 8 extending through the outer ring 7 and engaging the inner rign 10 via the groove 11.

The Coker et al patent discloses an exercise machine having a plurality of separate and independent lever arms pivotally connected to a frame, each arm being associated with independent stacks of weights which are slidably mounted on the frame with means to secure a selected number of weights in a stack of weights for each associated lever arm.

Lambert, Jr., Pat. No. 4,239,210 discloses a machine for use in exercising the upper arm area by performing what is known as an arm curl. One's arm is extended over a shroud 2 and the hand bar 25 is gripped. The user then moves the device in opposition to weights which are cam actuated so as to provide increasing resistance.

In some respects Brentham and Lambert, Jr. Pat. No. 4,373,717 come closest to providing devices which achieve some of the actions provided for in the instant invention. Both disclose means for resisting rotation of the wrist and rocking (as distinguished from casting) of the wrist; this distinction will be explained below. Brentham has a grip 38 by which rotational exercise of the wrist and forearm is effected and a member 70 by means of which a rocking of the wrist is achieved. In Lambert, Jr. these actions are achieved via the handgrip 1 and handgrips 16 respectively. Each patent discloses various means for increasing the resistance to the particular exercise being effected.

The Allen patent discloses an arm wrestling device which is for use by one person but which simulates arm wrestling between two persons.

DISCLOSURE OF THE INVENTION

The instant device for exercising muscles associated with elbow tendonitis, including also the hand and wrist, provides a means for strengthening the muscle surrounding the elbow joint for either the left or right arm. It is a compact resistance device which provides adjustable forces to resist user applied handgripping motion, forearm twisting motion, wrist casting motion, wrist rocking motion, and a combination of many of these. Repeated motion against an adjustable resistance, imitating the motions of a tennis serve or golf swing, for example, without the impact shock normally associated therewith, will gradually strengthen those muscles which seem to be so vulnerable in these sports and other activities involving the elbow. Not only will such strengthening help prevent "tennis elbow", but also it may improve the overall strength of one's arm and, for example, the power of one's service or golf swing.

The primary advantage of this development over the known prior art devices is that it provides a means of exercising the muscles in all of the aforementioned motions, and it provides for exercising these muscles through either individual or a combination of resistance motions. The arm twisting exercise, for example, can be done by itself, and the handgripping exercising can be done by itself. These two exercises, however, can also be done simultaneously—more nearly duplicating the muscle stresses experienced, for example, in an actual tennis serve.

Another important feature of this invention is that all of the motion resistances can be adjusted to suit the current strength of the user's muscles. As strength is improved, the user can gradually increase the resistance force to whatever level is desired. This makes the invention useful not only in preventing the occurrence of "tennis elbow" but it also makes it readily adaptable for use in recovering from that affliction.

Another advantage of the invention is the compactness of the device in which it is incorporated. Such device is intended to sit on the top of a table in front of which the user can stand with arm extended horizontally to grip the mechanism handle. The total package occupies a cube of less than 20 inches on a side and weights less than 25 pounds. It will be understood by those skilled in the art, however, that a self-standing, floor resting model could be adapted to incorporate the invention and it would even be possible to provide a device with a seat supported from it and the floor.

DETAILED DESCRIPTION OF THE INVENTION

The preferred embodiment of the device incorporating the invention comprises a single base for two independent mechanisms mounted on common axis with a common handle interface between user and mechanisms; an optional attachment enabling a further exercise function may also be utilized.

One mechnism is for handgripping (squeezing). It utilizes an extension spring connected via cable to a pivoting arm with a gripping handle. Squeezing this movable handle against a parallel fixed handle causes the cable to stretch the extension spring which thereby provides the resistance force. The fixed end of the extension spring is held by a pin in a multiposition slot in the base. This slot adjustment permits preloading the extension spring such that the intial tension on the cable ranges from 10 lbs. to 24 lbs. An adjusting screw permits adjustment of the gripping stroke length (for different user hand sizes) from 1½ inches to 3 inches. The maximum cable tension to be generated is preferably in the neighborhood of 40 lbs.

The other basic mechanism is for forearm twisting and wrist casting; the attachment also makes it available for wrist rocking. This mechanism utilizes a 4 inch diameter friction disk to provide torsional resistance. The fixed handle of the gripping mechanism serves as the handle for the twisting and casting motions. The entire handle system rotates about the axis of the gripping mechanism cable. This is also true when the wrist rocking attachment is utilized. The arrangement permits the simultaneous operation of the gripping mechanism and the rotatable friction disk mechanism during certain exercises. The rotatable friction disk is loaded against a fixed friction disk by a compression spring. The compression spring force is adjusted by means of a handwheel/nut, on a threaded rod inside the compression spring.

The friction torque can, by the foregoing arrangement, be infinitely varied between zero and 50 lb.-in. The fixed friction disk slides on the threaded rod to allow the compression spring to push it against the rotatable disk. This slidable disk, however, is restrained from rotating. The rotatable disk is connected to a shaft driven by a handle bracket and supported by a bearing block attached to the base such that the two disks are concentric. The friction disks are either dry or they may have a film of viscous grease between them. In either case, a high coefficiency of friction is maintained to generate torsional motion resistance.

The friction disk arrangement allows the torsional resistance to be essentially constant throughout the twist, casting or rocking motions. The same resistance occurs in both directions of twist so that the same device is used for the left and right arms.

Figure 1:
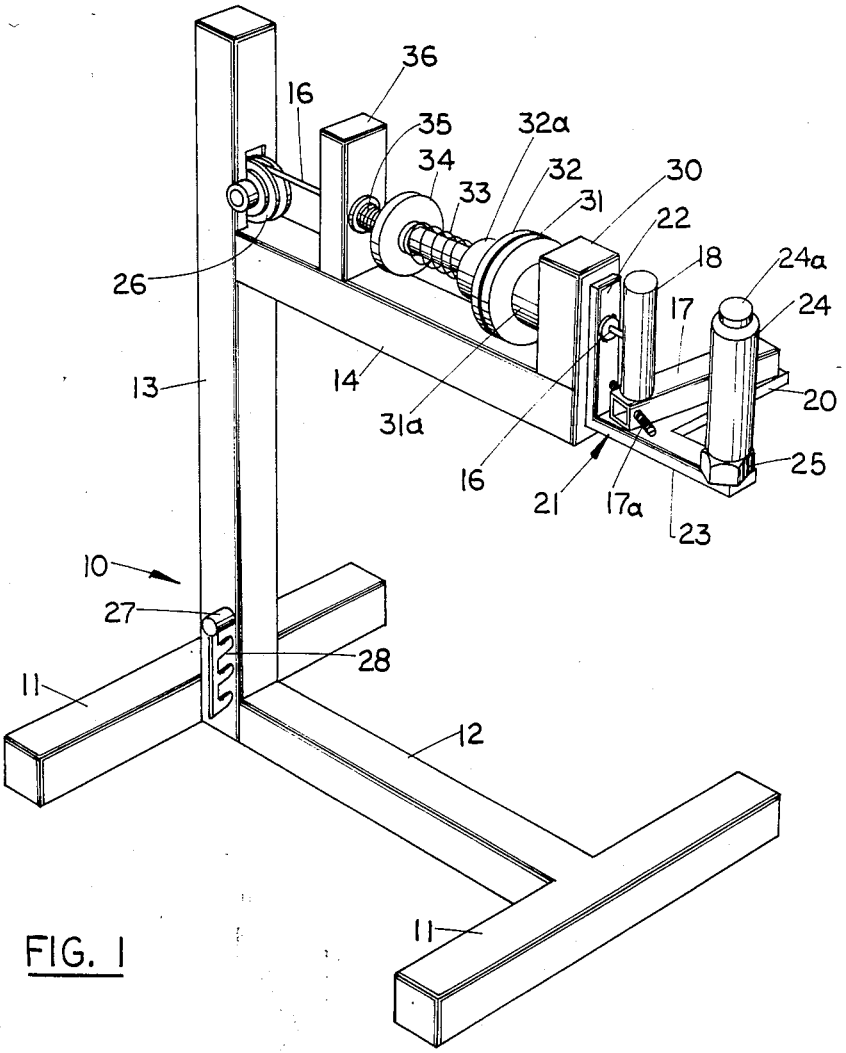
FIG. 1 is a perspective view of the preferred, table mounted embodiment of the invention.

Referring now to the drawings, particularly FIG. 1, the exercising device of this invention comprises a base frame generally indicated at 10 and comprised of a pair of horizontally disposed, parallel base frame members 11 joined by a centrally located frame member 12 and including an upstanding post 13 to which is rigidly secured a horizontally disposed frame member 14 disposed parallel to and spaced from the frame member 12. The single base frame 11–14 is a rigid unit which in its preferred form is adapted to rest on the top of a table in front of which the user can stand with arm extended horizontally to operate the mechanism. It will be apparent to those skilled in the art, however, that it would be possible to make this a floor model simply by extending the post 13 and perhaps by increasing the length of the members 11 to gain increased stability.

The frame 10 comprised of the members 11–14 supports two independent mechanisms mounted on a common axis with a common handle interface between the user and such mechanisms. One of these basic mechanisms is for handgripping (squeezing) and this includes an extension spring 15 (see FIG. 4) connected via a cable 16 to a pivoting arm 17 having a vertical gripping handle 18 mounted thereon. The pivoting arm 17 is pivotally connected as indicated at 19 (see FIG. 5) to a horizontal right angle extension 20 which is a part of the L-shaped mechanism generally indicated at 21 and which is comprised of the vertical leg 22 and horizontal leg 23. A vertical handle 24 is affixed to the member 23 parallel to the gripping handle 18. This handle 24 is comprised of a bolt or pin **24*a* fixed adjacent the free end of the member 23 by means of a jam nut 25. The handle 24 may comprise a piece of tubing which can rotate about the pin 24*a*** through its center.

The cable 16 which is affixed at one end to the gripping handle 18 passes over a pulley 26 and down through the hollow post 13 to the upper end of the extension spring 15. The lower end **15*a* of that extension spring 15 is fixed to a horzontal pin 27 which is adapted to be received in one of a plurality of notches 28**.

An adjusting screw **17*a* is threaded through the swing arm 17 and abuts the vertical member 22. The tension of cable 16 normally holds the end of screw 17*a* against the member 22. Adjustment of the screw 17*a* changes the distance between post or handle 18 and handle 24**.

From the foregoing it will be seen that one may squeeze the movable handle 18 toward the fixed handle 24 to cause the cable 16 to stretch the extension spring 15 which thereby provides the resistance force. The fixed end of the extension spring is held by the pin 27 in a multiposition slot 28 in the lower end of the hollow post 13. This slot adjustment permits preloading the extension spring 15 such that the initial tension on the cable may be adjusted. In practice it has been found that a range from 10 lbs. to 24 lbs. is satisfactory. The screw **17*a* permits adjustment of the gripping stroke length between the handles 24 and 18**, for different user hand sizes. A range from 1½ inches to 3 inches has been found satisfactory. Generally the maximum cable tension that should be generated is approximately 40 lbs.

The second mechanism is for forearm twisting and wrist casting. This mechanism also utilizes the L-shaped member 21 and fixed handle 24. The L-shaped member 21 is affixed (as by welding **22*a*, for example) to the end of a shaft 29 which is rotatably mounted within a vertical post 30 extending from the base frame member 14. The other end of the shaft 29 is affixed to a rotatable friction disk 31. The rotatable friction disk 31 is affixed to the shaft 29 via a set screw 29***a* in the hub 31*a* of disk 31 and it will be understood by those skilled in the art that by this arrangement the friction disk 31 and L-shaped member 21 will rotate together on the shaft 29 suitably located within the vertical post 30. Such rotation may be effected by the user grasping the fixed handle 24 or, in some cases as will be described shortly, by grasping both of the handles 18 and 24.

The rotatable friction disk 31 is loaded against a fixed friction disk 32 by a compression spring 33. The compression spring force is adjusted by means of a handwheel/nut 34 on a threaded rod 35 inside the compression spring 33. One end of the rod 35 is rigidly affixed to the stand 36 while the other end of the rod 35 extends through the hub 32*a* of the fixed friction disk 32. The cable 16 which is attached to the movable handle passes through the members 29, 31*a*, 31, 32, 32*a* and 35, and over the pulley 26 for attachment with the spring which is secured to the pin 27 which may be located in a selected notch 28 in the post 13.

The just described arrangement is such that the entire handle system generally indicated at 21 and including the movable handle 18 and fixed handle 24 rotates about the axis of the gripping mechanism cable 16. This permits the simultaneous operation of the gripping mechanism via the handles 18 and 24 which are squeezed so as to bring the handle 18 towards the handle 4 (see the dotted line position indicated in FIG. 5), and the rotatable friction disk mechanism via the fixed handle 24, members 22 and 23, and members 29, 31a and 31. The friction disk 32, 32*a* is fixed against rotation by means of a pin 37 fixed thereto and slidable in the frame member 14. This friction disk 32, 32*a*, however, is slidable on the rod 35 and the arrangement of the spring 33 and nut 34 is preferably such that the friction torque between the friction disks 31 and 32 can be varied as desired between zero and approximately 50 lbs.-in. The friction disks 31 and 32 may be either dry or they may have a film of viscous grease between them. In either case, a high coefficiency of friction is maintained to generate torsional motion resistance. In a preferred embodiment a third member, such as a sheet of cork 50 or the like, may be inserted between the disks 31 and 32 to obtain a high coefficient of friction without abrasive wear on the disks. The cork disk 50 can be attached to either disk 31 or 32.

Figure 2:
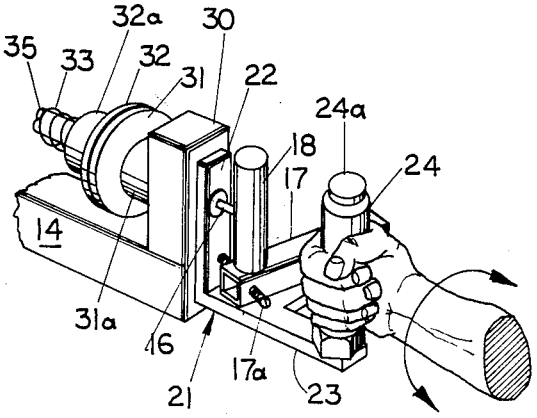
FIG. 2 is a fragmentary, perspective view diagrammatically illustrating the invention when used in conjunction with forearm twisting.
Figure 3:
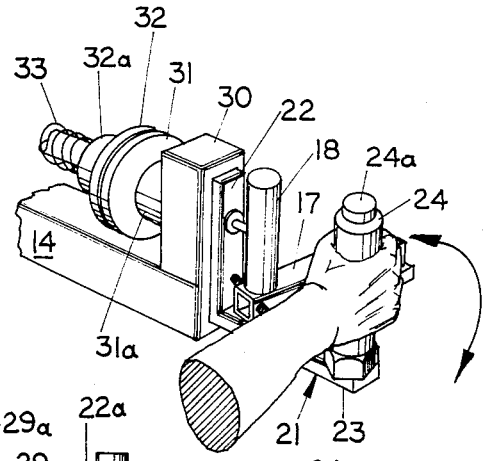
FIG. 3 is a fragmentary perspective view of the invention when used in conjunction with wrist casting.

FIGS. 2 and 3 illustrate two different forms of the manner in which torsional resistance is utilized. In FIG. 2 the arm of the user extends in line with the axis of the cable 16 and related mechanism and only the handle 24 is gripped, the fingers being arranged vertically. The handle 24 and L-shaped mechanism 21 may be rotated in the directions indicated by the arrow in FIG. 2 and such rotation is resisted by the friction applied between the disks 32 and 31 as regulated by the spring 33 and nut 34 in the manner previously described. This demonstrates what has previously been referred to herein as forearm twisting.

FIG. 3 illustrates what has previously been described as wrist casting. For this utilization of the device the user extends his arm at right angles to the axis of the cable 16 and again grasps only the handle 24, the fingers again being vertically aligned. The handle 24 is then moved toward and away from the user in the manner indicated by the arrows in FIG. 3. This stimulates a casting motion, a motion that is utilized in fishing as well as in certain tennis strokes, golf swings and the like.

Figure 5:
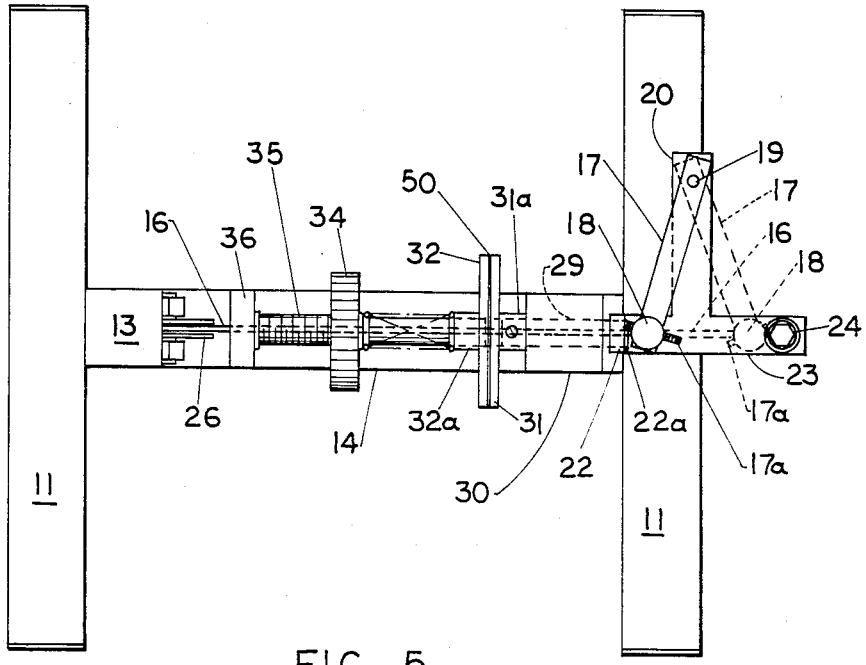
FIG. 5 is a top plan view of the invention illustrating how it may be used in conjunction with handgripping.

In FIG. 5 handgripping, squeezing, is illustrated. In this operation the user places his hand about both handles 24 and 18 and pulls the handle 18 against the action of the extension spring 15 via the cable 16 and towards the handle 24. This can be done when the user's arm is in either the FIG. 2 or FIG. 3 position. Additionally, squeezing may be combined with the arm twisting illustrated in FIG. 2 and it may be combined with the wrist casting illustrated in FIG. 3. Thus, the mechanisms so far described provide for handgripping or squeezing, forearm twisting, wrist casting, combined squeezing and forearm twisting, and combined squeezing and wrist casting.

Figure 4:
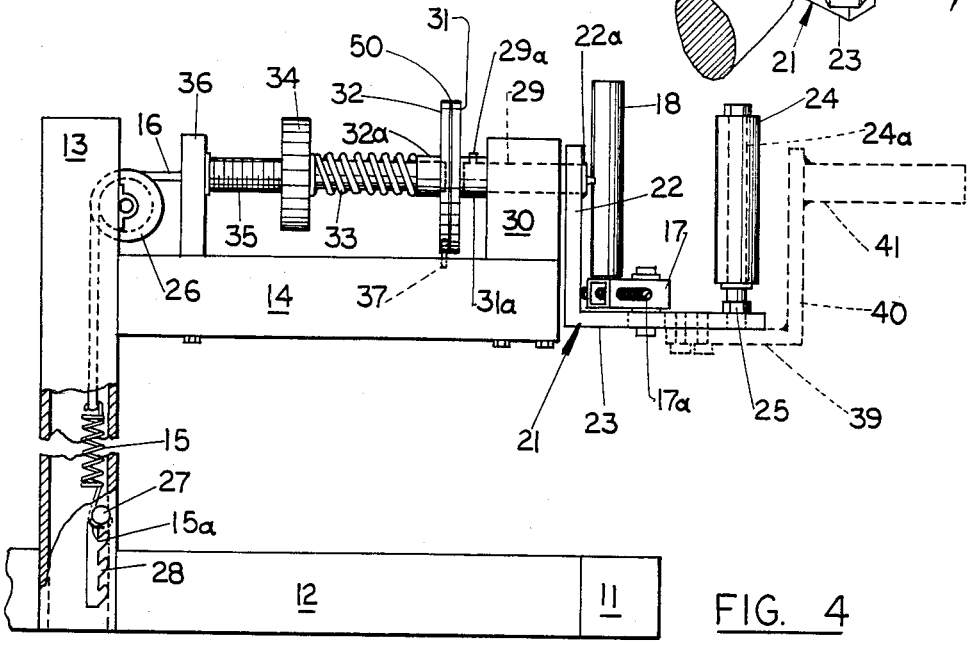
FIG. 4 is a side elevation, partly in section and partly fragmented, disclosing the invention and illustrating, in phantom, an attachment which may be used in conjunction with wrist rocking.

A sixth action is also possible and this is illustrated by the attachment shown in dotted lines in FIG. 4. To this end an L-shaped bracket comprised of the legs 39 and 40 is attached to the member 23 of the L-shaped handle mechanism 21. Another handle 41 extends at right angles to the bracket member 40 and is located in alignment with the axis defined by the cable 16. With this attachment in place, the user grasps the handle 41 with the knuckles of the fingers being horizontally disposed. The user may then move the handle 41 and associated mechanisms 40, 39, 23, 22, 29, 31*a* and 31 against the friction imparted to the disk 31 via the disk 32, 32*a* and spring 33 as regulated by nut 34. This provides an up and down wrist motion which may also be described as wrist rocking as distinguished from the wrist casting illustrated in FIG. 3.

The device for exercising muscles associated with elbow tendonitis, including also the hand and wrist, as above described provides for complete exercise of all the major muscles involved with tendonitis and related ailments. The six described actions, all of which may be varied by adjustments in one or the other or both of the springs 15 and 33, are handgripping or squeezing, forearm twisting, wrist casting, wrist rocking, combined forearm twisting and hand squeezing, and combined wrist casting and hand squeezing. The friction disk arrangement allows the torsional resistance to be essentially constant throughout the arm twisting, wrist casting and wrist rocking motions, the first being illustrated in FIG. 2, the second in FIG. 3 and the latter in FIG. 4 wherein provision is made via the attachment for the up and down wrist motion which is defined as wrist rocking.

It will be apparent to those skilled in the art that modifications may be made in this invention without departing from the scope and spirit thereof. By way of examples only it will be evident that different friction disk materials, disk sizes, and disk compression loading arrangements may be utilized. The use of multiple disks and/or elements between the disks to increase rotational friction may be possible.

Further possible modifications include a gripping resistance force which is generated by means of weights or a compression spring rather than the extension spring illustrated. It may also be possible to provide a gripping arrangement that uses a translating handle motion or one pivoted in a different orientation from the one described above.

In any event, although the invention has been described in terms of particular structures and arrangements, nevertheless the invention is not to be limited to such particular structures and arrangements except insofar as they are specifically set forth in the subjoined claims.

What is claimed as new and patentable is:

1. A device for exercising muscles associated with elbow tendonitis including also the hand and wrist, said device comprising a main frame including and first force means urging said first handle away from said second handle and second force means resisting rotational movement of said handle means; whereby a handgripping - squeezing action may be effected by a user gripping both handles with one hand and pulling said first handle towards said second handle with said hand in opposition to said first force means; whereby a forearm twisting action may be effected by a user gripping said second handle with one hand while the forearm is substantially aligned with said first and second handles and rotating said handle means in opposition to said second force means; whereby a wrist casting action may be effected by a user gripping said second handle with one hand while the forearm is substantially at right angles to the last mentioned position of said forearm; and whereby the forearm twisting action and the wrist casting action may respectively be combined with the handgripping - squeezing action.

2. The device of claim 1 including a horizontally disposed third handle mounted on said handle means, whereby a wrist rocking movement may be effected by a user gripping said third handle with one hand while the forearm is in substantially the same position as for wrist casting.

3. The device of claim 1 in which said first force means comprises a cable connected to said first handle and a first spring attached to said cable and to said main frame whereby to urge said first handle away from said second handle.

4. The device of claim 1 in which said second force means comprises a first friction disk affixed to said handle means for rotation therewith and a second friction disk non-rotatably engagable with said first friction disk and a second spring which urges said second disk into engagement with said first disk whereby to resist rotational movement of said handle means.

5. The device of claim 3 in which said second force means comprises a first friction disk affixed to said handle means for rotation therewith and a second friction disk non-rotatably engagable with said first friction disk and a second spring which urges said second disk into engagement with said first disk whereby to resist rotational movement of said handle means.

6. The device of claim 5 in which said cable and said second spring are horizontally disposed, said cable passing through the centers of said first and said second friction disks which are both vertically disposed, said second spring being an elongated compression spring and said cable also passing through the center of said second spring; whereby a user may align the forearm with said cable for the said handgripping - squeezing action, the said forearm twisting action and the combination of these just mentioned actions, and whereby the forearm may be positioned at right angles to the cable for the wrist casting action, the handgriping - squeezing action, and the combination of these last two just mentioned actions.

7. The device of claim 6 including a horizontally disposed third handle on said handle means in alignment with said cable for wrist rocking action.

8. The device of claim 6 including means for adjusting said first and said second forces.

9. The device of claim 1 including an adjustment means for regulating the space between said first and said second handles.

10. The device of claim 3 in which said main frame is provided with a plurality of notches, said first spring being attached to a pin which may be located within a selected one of said notches, whereby to adjust the force of said first spring.

11. The device of claim 6 in which said main frame includes a vertical post from which said horizontally disposed support arm extends, a first vertical bracket on said support arm and having a shaft horizontally journaled therein, said handle means being rigidly secured to one end of said shaft and said first friction disk being secured to the other end of said shaft, a second vertical bracket on said support arm and spaced from said first bracket, a horizontally disposed rod rigidly secured to said second vertical bracket, said rod and said shaft having their axes aligned, said second friction disk being non-rotatably slidable on said rod and said second spring being disposed about said rod, said cable passing through said shaft and said rod.

12. The device of claim 11 including a handwheel/-nut threaded on said rod and said second spring abutting said handwheel/nut and said second friction disk, whereby said second force may be adjusted by moving said handwheel/nut on said rod.

13. The device of claim 12 in which said cable passes over a pulley for attachment to one end of said first spring which is vertically disposed, the other end of said first spring having an adjustable attachment to said vertical post, whereby to adjust said first force, said pully being journaled on said vertical post.

14. The device of claim 13 including a pin secured to said other end of said first spring, said vertical post having a plurality of vertically disposed notches therein, and said pin being located in a selected one of said notches.

* * * * *

UNITED STATES PATENT AND TRADEMARK OFFICE

CERTIFICATE OF CORRECTION

PATENT NO. : 4,570,925

DATED : February 18, 1986

INVENTOR(S) : Kock et al

It is certified that error appears in the above—identified patent and that said Letters Patent is hereby corrected as shown below:

Column 7, line 6, after "including" insert - an elongated horizontally disposed support arm; handle means for gripping by the user to initiate exercising, said handle means being pivotally mounted on the end of said arm for both clockwise and counterclockwise rotation in a plane vertically transverse of the longitudinal axis of said arm, said handle means having a first handle normally vertically disposed thereon and longitudinally pivotal and a second handle parallel to said first handle and in a fixed position spaced from said first handle; -

Signed and Sealed this

Thirteenth Day of January, 1987

*Attest:*

DONALD J. QUIGG

*Attesting Officer*

*Commissioner of Patents and Trademarks*